United States Patent [19]

Allred

[11] 3,940,658

[45] Feb. 24, 1976

[54] ELECTRONIC IGNITION CONTROL SYSTEM

[75] Inventor: Michael V. Allred, Irving, Tex.

[73] Assignee: Superior Industries, Inc., Dallas, Tex.

[22] Filed: May 20, 1974

[21] Appl. No.: 471,814

Related U.S. Application Data

[63] Continuation-in-part of Ser. No. 427,584, Dec. 26, 1973.

[52] U.S. Cl. ..... 315/209 T; 123/148 E; 315/209 R

[51] Int. Cl.[2] ..... F02D 1/00

[58] Field of Search . 123/148 E; 315/209 R, 209 T, 315/211; 307/315

[56] References Cited

UNITED STATES PATENTS

| | | | |
|---|---|---|---|
| 3,496,921 | 2/1970 | Boyer | 315/209 R X |
| 3,605,713 | 9/1971 | Le Masters | 315/209 R X |
| 3,749,974 | 7/1973 | Kissel | 315/209 T |

*Primary Examiner*—R. V. Rolinec

*Assistant Examiner*—Lawrence J. Dahl

*Attorney, Agent, or Firm*—Richards, Harris and Medlock

[57] ABSTRACT

An electronic ignition control system having a magnetically triggered input has an electronically controlled duty cycle to improve output voltage from a standard ignition transformer at increased engine speeds. A pulse width forming amplifier consisting of multiple transistor stages and associated components provides a power amplifying function combined with a timing function for improved ignition system performance. Sharp rise time pulses and noise immunity are realized by use of multiple feedback loops and low pass filtering. Coupled to the pulse width forming amplifier is a Darlington amplifier as an output stage for reduced power consumption and dissipation. The Darlington amplifier output stage provides a decrease in turn off time with a corresponding decrease in switching losses. The output of the Darlington amplifier drives a standard ignition transformer coupled to a spark source through a rotary distributor.

17 Claims, 15 Drawing Figures

ELECTRONIC IGNITION CONTROL SYSTEM

This is a continuation-in-part of application Ser. No. 427,584 filed Dec. 26, 1973.

This invention relates to an electronic ignition control system, and more particularly to an ignition control system providing improved spark source performance with increased reliability.

Considerable research and development effort is being expended to provide an ignition system for internal combustion engines to replace the heretofore standard capacitor discharge ignition system. From this research and development effort, there has resulted a magnetic rotating reluctor transducer driven from the crankshaft of the internal combustion engine to provide a signal synchronized with engine rotation. Output signals from the magnetic reluctor transducer are utilized as an input signal to an electronic firing circuit to generate an output voltage to the standard ignition transformer to provide the high voltage required by the spark sources of the internal combustion engine. One such electronic firing circuit is described in U.S. Pat. No. 3,749,974, entitled ELECTRONIC IGNITION CONTROLLER, granted to William R. Kissel.

A feature of the present invention is to provide an electronic ignition control system having a firing circuit driven from a magnetic reluctor transducer and incorporating an electronically controlled duty cycle. This duty cycle is established in a multiple transistor input stage having regenerative feedback to minimize switching time. Another feature of the present invention is to provide a firing circuit in an electronic ignition control system providing reduced power consumption with decreased turn off time. The reduction of power consumption is achieved by a Darlington amplifier output stage. Still another feature of the present invention is an electronic ignition control system with simplified circuitry to provide increased reliability. In addition, the firing circuit of the control system is selectively coupled directly to a source of DC energy or indirectly at the junction between an ignition transformer primary winding and a current limiting ballast resistor.

In accordance with the present invention, an electronic ignition control system responds to an electrical signal from a mechanical-to-electrical transducer and provides a trigger voltage to a spark source. The control system comprises a multiple stage pulse width amplifier having an input transistor and an output transistor with a feedback circuit connected from the collector electrode of the output transistor to the collector electrode of the input transistor. Coupled to the output transistor is an output driver including a Darlington amplifier that provides a control voltage. This control voltage connects to the primary winding of an ignition transformer to generate at the terminals of the transformer secondary winding the trigger voltage to a spark source.

A more complete understanding of the invention and its advantages will be apparent from the specification and claims and from the accompanying drawings illustrative of the invention.

Referring to the drawings.

Figure 1:
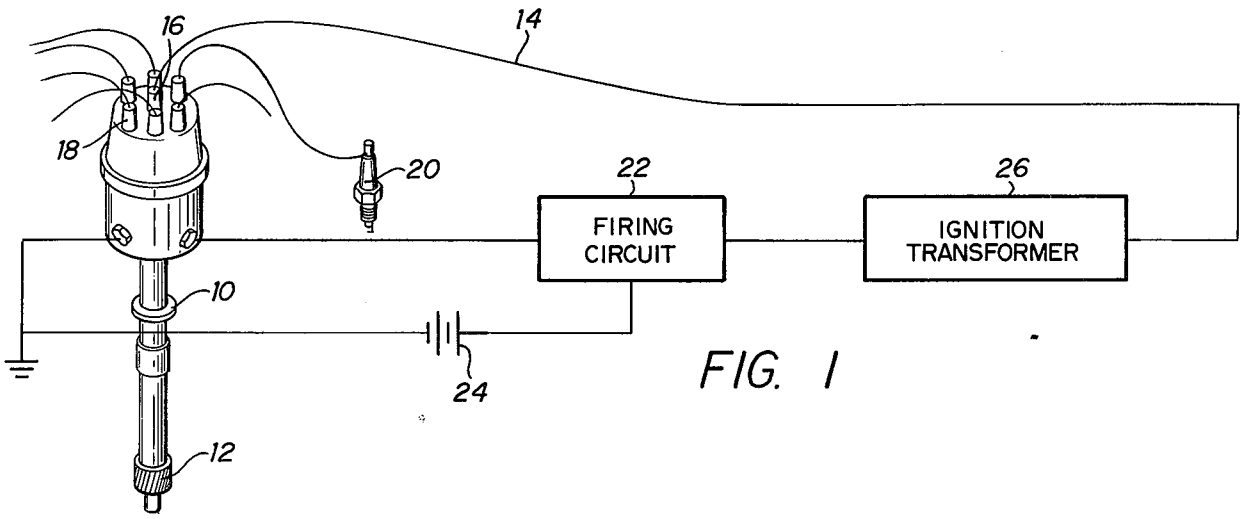
FIG. 1 is a schematic diagram of an ignition system for an internal combustion engine wherein the firing circuit of the present invention is coupled between a distributor device and a high voltage transformer.

Referring to FIG. 1, there is shown an ignition control system where a rotary type distributor 10 is driven by means of a gear 12 from the crankshaft of an internal combustion engine, such as the standard engine used by the automative industry. Included within the distributor 10 is a rotary contactor coupling a high voltage line 14, as connected to a central terminal 16, to one of six spark source terminals 18. In accordance with well established techniques, the high voltage on the line 14 is coupled sequentially to each of the spark sources 20 (only one shown) connected to one of the terminals 18.

Also included in the distributor 10 is a magnetic reluctance generator (not shown) of the type commercially available and utilized with presently available electronic ignition controllers. Pulse signals generated by a coil of the magnetic reluctance generator are connected to the input of a firing circuit 22 supplied a drive voltage from a DC source, such as the battery 24. A control voltage generated at the output of the firing circuit 22 is applied to the primary winding of an ignition transformer 26 that genrates a trigger voltage at a high potential on the line 14.

The magnetic reluctance generator within the distributor 10 provides pulse signals to the firing circuit 22 synchronized with the rotation of the gear 12 which, as explained, is direct driven by the crankshaft of an internal combustion engine. Thus, the firing circuit 22 receives signals synchronized with rotation of the internal combustion engine to provide control voltages to the ignition transformer 26 that is also synchronized with engine rotation. The output of the transformer 26 on the line 14 provides a high potential in synchronism with engine rotation. By means of the rotary contactor within the distributor 10, this high voltage potential is connected to one of the spark sources 20.

Figure 2:
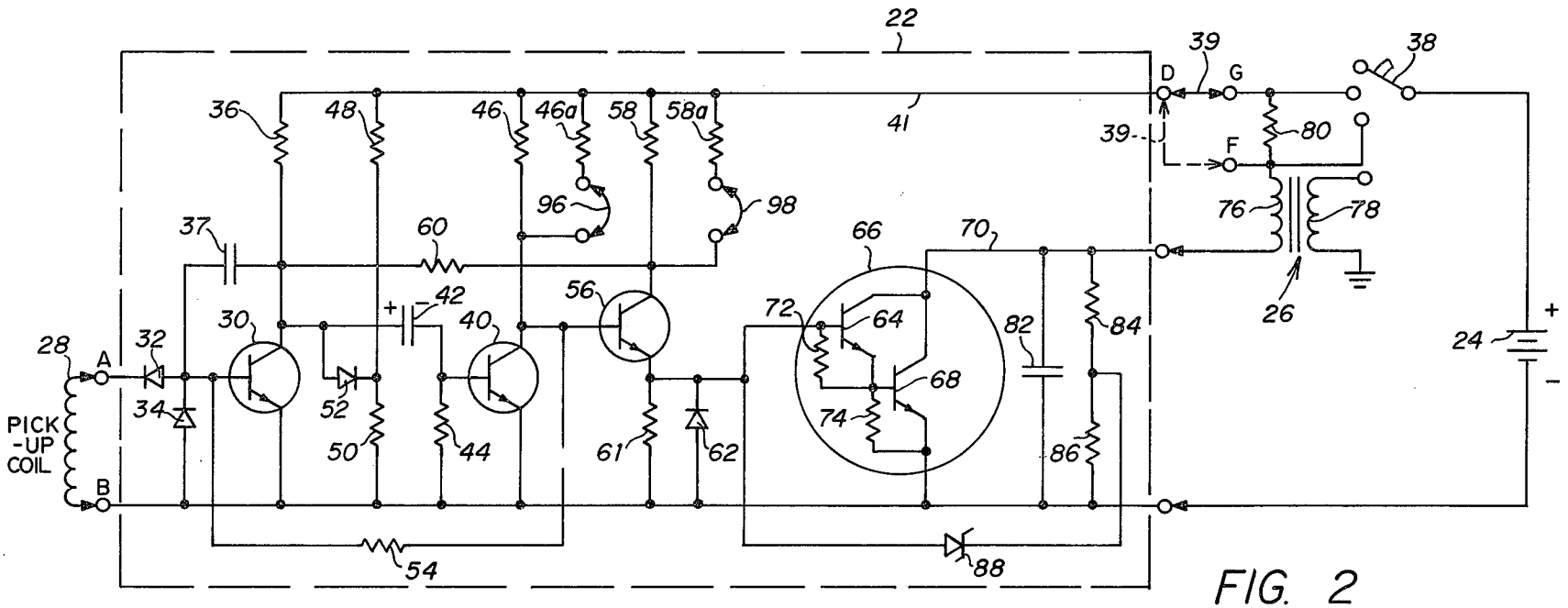
FIG. 2 is a schematic diagram of the firing circuit of FIG. 1 in accordance with the present invention.

Referring to FIG. 2, there is shown a schematic diagram of the firing circuit 22 wherein a pickup coil 28 of the magnetic reluctor within the distributor 10 has one terminal connected to the battery source 24 and a second terminal connected to the base electrode of an input stage transistor 30 through a diode 32. The input stage transistor 30 is one of three stages of a pulse width amplifier for establishing the duty cycle of the firing circuit. Also coupled to the base electrode of the transistor 30 is a clamping diode 34 that clamps a negative swing of the voltage at the pickup coil 28 from damaging the transistor 30.

Connected to the collector electrode of the transistor 30 is a drive resistor 36 for establishing current levels through the transistor from the battery 24 through a three position ignition switch 38 and a connecting link 39. The purpose of a connecting link 39 will be explained.

Coupled between the collector and base electrodes of the transistor 30 is a filtering capacitor 37 that functions to prevent transients on the line 41, or transients from the pickup coil 28 from false triggering the timing circuit of the pulse width amplifier.

A voltage developed at the collector electrode of the transistor 30 is capacitor coupled to the base electrode of a second stage transistor 40 through a capacitor 42. Also coupled to the base of the transistor 40 is a resistor 44 that establishes the discharge time constant of the capacitor 42 as part of the timing circuit. A drive resistor 46 connected to the battery 24 and the collector electrode of the transistor 40 establishes the operating current level of the transistor. Both the transistors 30 and 40 have a grounded emitter connection to the negative terminal of the battery 24.

While the discharge time constant of the capacitor 42 is established by the resistor 44, the charging time is determined by a divider network including resistors 48 and 50 with a diode 52 connected to the capacitor 42 and the junction of the resistors 48 and 50. This timing function of the capacitor 42 will be explained.

Connected to the collector electrode of the transistor 40 is a feedback circuit including a resistor 54 connected to the base electrode of the transistor 30. This resistor 54 provides the base current for the input stage transistor 30 from the base electrode of a third stage transistor 56. The transistor 56 is the output stage of the pulse width amplifier with the base electrode direct coupled to the transistor 40. A drive resistor 58 connected to the battery 24 and the collector electrode of the transistor 56 establishes the operating current level of the transistor. A voltage generated at the collector of the transistor 56 is fed back to the collector of the transistor 30 through a feedback resistor 60. This serves to regenerate the timing function thereby improving the switching transition time.

An output signal from the transistor 56 appears at the emitter electrode as developed across a drive resistor 61. Also coupled to the emitter electrode of the transistor 56 is a clamping diode 62 and the base electrode of a transistor 64 as part of a Darlington amplifier output driver 66.

The Darlington amplifier comprises the transistor 64 and an emitter coupled transistor 68 having a common collector electrode connection to a line 70. A base drive voltage for the transistor 64 is developed across a resistor 72 and a base drive voltage for the transistor 68 is developed across the resistor 74. The emitter electrode of the transistor 68 and the resistor 74 are tied to the negative terminal of the battery 24.

Connected to the line 70 is the primary winding 76 of the ignition transformer 26 having a secondary winding 78 across which is developed a trigger voltage on the line 14 for applying to a spark source, such as the spark source 20. In series with the primary winding 76 is a ballast resistor 80 also tied to the positive terminal of the battery 24 through the ignition switch 38.

Connected across the Darlington amplifier 66 to resonate with the primary winding 76 is a capacitor 82 also tied to the negative terminal of the battery 24. In parallel with the amplifier 66 and the capacitor 82 is a divider network of resistors 84 and 86. The resistors 84 and 86 are part of a clamping circuit including a Zener diode 88 connected to the base electrode of the transistor 64.

The collector voltage of the amplifier 66 as appearing on the line 70 is impressed across the voltage divider network of resistors 84 and 86 to cause conduction of the Zener diode 88 to clamp the collector-to-base voltage differential to a value such as to prevent damage to the amplifier 66. This damaging high voltage may be caused by an open wire to a spark source or other similar fault.

In operation of the circuit of FIG. 2 and with reference to FIG. 3, with the ignition switch 38 in position No. 2 and no signal from the pickup coil 28, the input stage transistor 30 is turned on and conducting with the capacitor 42 discharged and the second stage transistor 40 turned off. The output stage transistor 56 is turned on and conducting which in turn causes conduction of the transistors 64 and 68 to develop a voltage across the primary winding 76.

To place the system in an initial condition for operation, that is, during the starting procedure of the internal conbustion engine driving the distributor 10, the ignition switch 38 is placed in position No. 3. The voltage supplied to the transistors 30, 40 and 56 is now supplied through the ballast resistor 80. After the internal combustion engine is operational, the ignition switch 38 is returned to position No. 2.

Figure 3A:
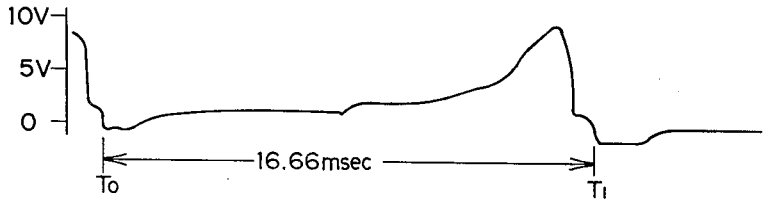
FIG. 3 is a series of waveforms illustrating voltage levels generated by the operation of the circuit of FIG. 2.

As the pickup coil 28, which is located in close proximity to a rotating reluctor mechanically coupled to the crankshaft of an engine and rotor of a distributor, produces a negative crossing pulse, as shown at the time $T_o$, of FIG. 3*a*, the diode 32 becomes forward biased thereby drawing base current supplied by resistor 54 from the transistor. Drawing base current from the transistor 30 causes the voltage at the collector electrode of the transistor 30 to go positive as shown by curve 94 of FIG. 3*b*, and this voltage change is coupled through the capacitor 42 to the base electrode of the transistor 40.

The positive going pulse (shown in FIG. 3*c*) at the base electrode turns on the transistor 40 thereby causing a voltage at the collector electrode (shown in FIG. 3*d*) to drop to near the negative voltage potential of the battery 24, that is, near zero. This near zero collector voltage at the transistor 40 is coupled back to the base electrode of the transistor 30 through the resistor 54 thereby turning off the transistor 30.

The near zero voltage at the collector of the transistor 40 is also coupled to the base electrode of the transistor 56 and this transistor turns off. The voltage at the collector electrode of the now turned off transistor 56 (shown in FIG. 3*c*) is coupled back to the collector electrode of the transistor 30 through the resistor 60.

As the transistor 56 turns off, the emitter electrode voltage goes to near ground potential (shown in FIG. 3*f*) thereby turning off both the transistors 64 and 68 of the Darlington amplifier 66. Turning off the Darlington amplifier 66 causes energy stored in the windings of the transformer 26 to be released by the collapsing magnetic field. This collapsing magnetic field induces a high voltage in the secondary winding 78 to fire the spark source 20. During this time, the primary winding 76 is resonating with the capacitor 82 thereby causing the collector electrodes of the transistors 64 and 68 to swing negative and the transistor 64 is clamped by forward biasing the diode 62 across the base-emitter junction of the amplifier 66.

Figure 3B:
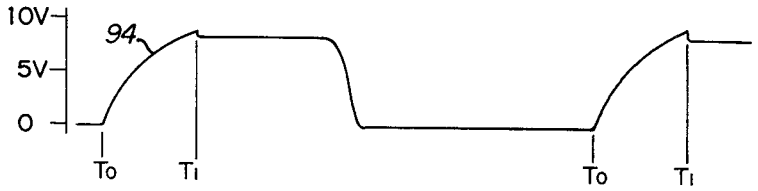
Figure 3C:
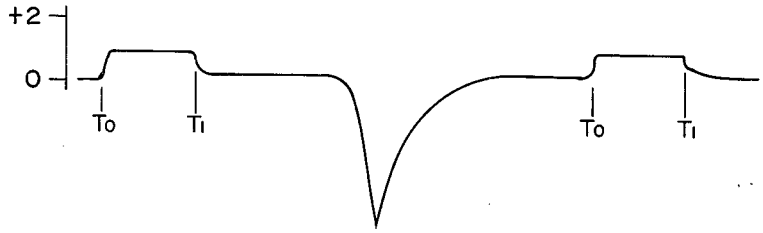
Figure 3D:
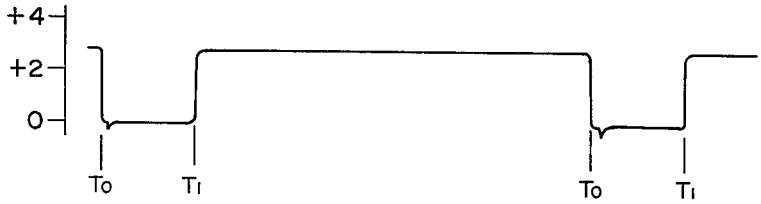
Figure 3E:
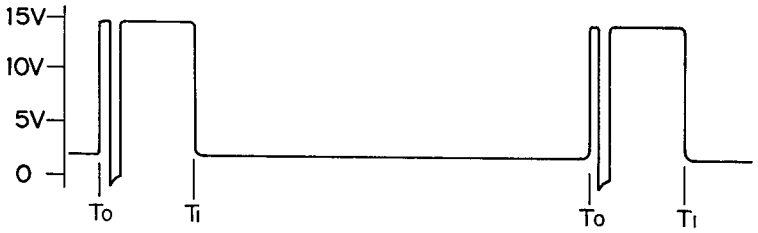
Figure 3F:
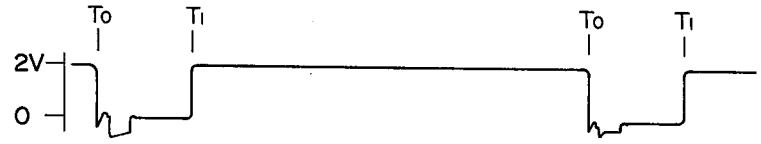

As illustrated in FIG. 3*f*, when a signal is received from the pickup coil 28 at time $T_o$, the transistors of the amplifier 66 are conducting. When the transistor 56 goes nonconducting, the transistors 64 and 68 likewise go nonconducting.

Figure 4:
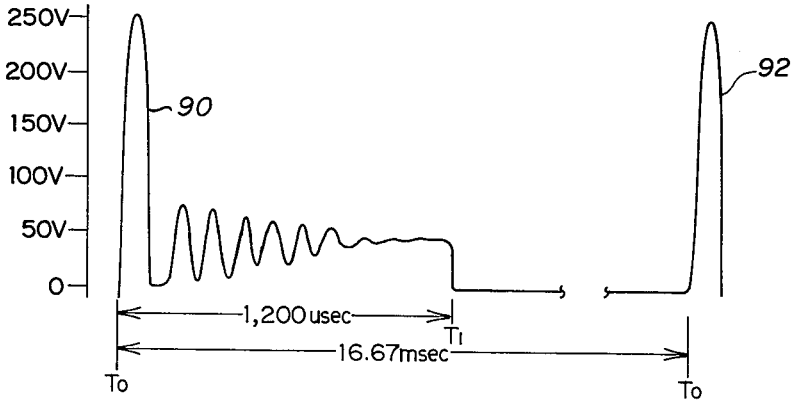
FIG. 4 is a typical waveform at the output terminals of the firing circuit of FIG. 1 as connected to the high voltage transformer.

With reference to FIG. 4, there is shown a typical waveform of the control voltage on the line 70 as applied to the primary winding 76. The spike 90 is generated at the time $T_0$ by switching off the amplifier 66. The following voltage ripples are produced by the resonating of the primary winding 76 with the capacitor 82. The next pulse 92 is produced at a subsequent turning off of the transistor 56.

Subsequent to the time $T_0$ the signal from the pickup coil 28 is clamped by the diode 34 to prevent damage to the transistor 30 caused by excessive voltage and zenering of the base-emitter junction of the transistor. As the transistor 30 is turned off at time $T_0$, the collector voltage continues to increase along the curve 94 of FIG. 3*b* to charge the timing capacitor 42 through the forward biased base-emitter junction of the transistor 40. The voltage at the collector electrode of the transistor 30 is also coupled to the divider network of resistors 48 and 50 through the diode 52. When the collector voltage of the transistor 30 forward biases the diode 52, any further charging current to the capacitor 42 (and therefore base drive current to the transistor 40) is diverted to the low impedance divider network. This occurs at time $T_1$ and the base current to the transistor 40 begins to decrease until the transistor turns off.

When the transistor 40 turns off, the collector voltage, as shown by the curve of FIG. 3*d*, goes positive to again turn on the transistor 56. Turning on the transistor 56 drives the voltage at the collector electrode low and this voltage is coupled back to the collector of the transistor 30 through the resistor 60. This action is regenerative to insure the switching time of the circuit is at a minimum.

As the transistor 56 again turns on, base current is supplied to the transistors 64 and 68 as limited by the resistor 58. This again turns on the transistors 64 and 68 and energy is stored in the primary winding 76. This occurs at time $T_1$ as given by the curves 3*e* and 3*f* and also shown in FIG. 4.

The circuit is ready to receive another input pulse from the pickup coil 28 to produce the spike 92. This action is repeated so long as the pickup coil 28 provides an input signal to the transistor 30 at each time $T_0$.

Referring to FIGS. 3*b*–3*e*, during the period from time $T_0$ to time $T_1$ the collector electrode voltage of the transistor 30 varies in accordance with the curve of FIG. 3*b*. The time $T_1$ corresponds to the time when the diode 52 goes forward biased to shunt base current from the transistor 40 to the network of resistors 48 and 50. The transistor 30 is in an off state so long as the voltage at the collector electrode as shown in FIG. 3*b* is at the positive potential. During the same time period, the base voltage of the transistor 40 is varying in accordance with the curve of FIG. 3*c* and it is turned off only during the period from time $T_0$ to time $T_1$. The transistor 56 is conducting during the period from time $T_0$ to time $T_1$ as shown by the curve of FIG. 3*d* and is nonconducting in the period from time $T_1$ to the subsequent time $T_0$. The transistor 56 is switched rapidly to provide the desired switching times. During the period from time $T_0$ to time $T_1$ the collector electrode of the transistor 56 varies in accordance with the curve of FIG. 3*e* and again demonstrates fast switching times.

In an experimental model of the firing circuit 22 of FIG. 2, the various component values are given in Table I below.

TABLE I

| TYPICAL COMPONENT VALUES | |
|---|---|
| Capacitor 37 | .01 Mfd Ceramic |
| Capacitor 42 | .47 Mfd 35 Volt Tantalum |
| Capacitor 82 | .22 Mfd 400 Volt |

TABLE I-continued

| TYPICAL COMPONENT VALUES | |
|---|---|
| Diode 32 | 1 Amp 100 VPI |
| Diode 34 | 1 Amp 100 VPI |
| Diode 52 | 1 Amp 100 VPI |
| Diode 62 | 1 Amp 100 VPI |
| Diode 88 | 24 Volt 400 mw |
| Resistor 54 | 1K ohms |
| Resistor 36 | 3.3K ohms |
| Resistor 44 | 2.7K ohms |
| Resistor 48 | 470 ohms |
| Resistor 50 | 470 ohms |
| Resistor 46 | 1K ohms |
| Resistor 46a | 2.2K ohms |
| Resistor 60 | 10K ohms |
| Resistor 58 | 100 ohms |
| Resistor 58a | 200 ohms |
| Resistor 61 | 1K ohms |
| Resistor 86 | 470 ohms |
| Resistor 84 | 3.9K ohms |

As a modification of the circuit of FIG. 2 and the operation as described, a resistor 46*a* is connected in parallel with the resistor 46 by means of a jumper connection 96. Similarly, a resistor 58*a* is connected in parallel with the resistor 58 by means of a jumper connection 98. This alters the effective value of the resistance in the collector circuit of the transistors 40 and 56, respectively. When operated in this manner, the connecting link 39 is no longer connected between points D and G but rather connected between points D and F. As such, bias voltage is supplied to the pulses width amplifier through the ballast resistor 80 instead of a direct connection to the battery 24.

Figure 5:
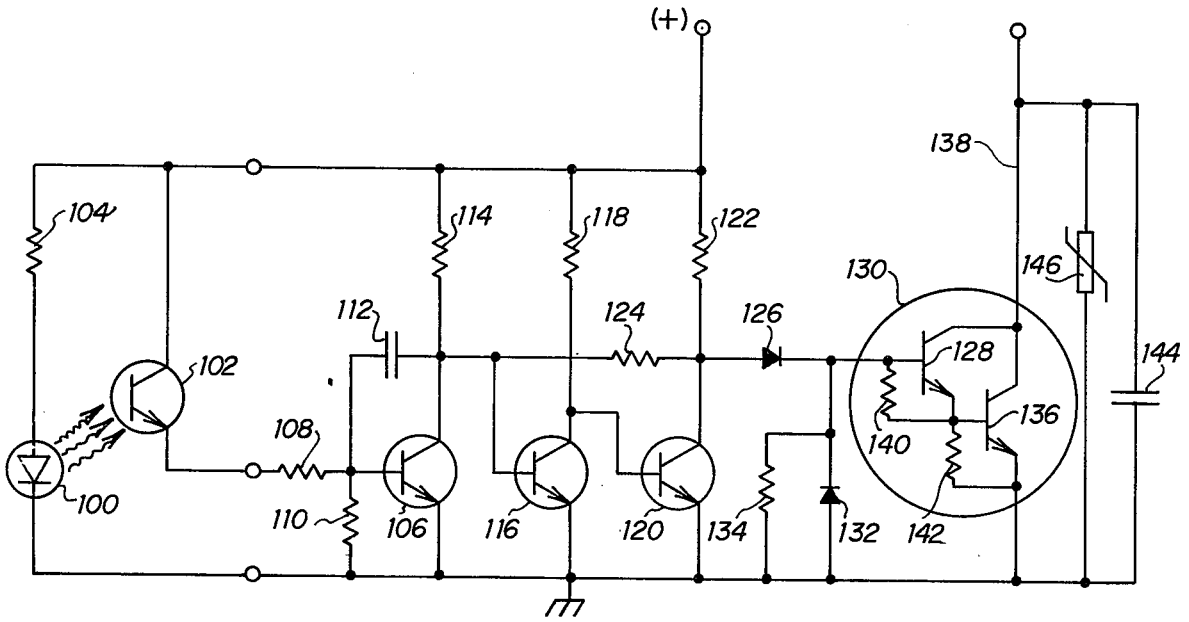
FIG. 5 is a schematic diagram of an alternate embodiment of the firing circuit of FIG. 1 in accordance with the present invention.

Referring to FIG. 5, there is shown a schematic diagram of an alternate embodiment of the firing circuit 22 where a light emitting diode 100 generates light wave energy to a photo transistor 102 as part of the distributor 10. The pickup assembly comprising the diode 100 and the transistor 102 is mounted within the distributor housing such that the light beam from the diode is broken by a disc attached to a distributor shaft driven by the gear 12. This disc (not shown) includes a plurality of slotted segments to periodically interrupt the light beam between the diode 100 and the transistor 102 such that the firing circuit 22 receives signals synchronized with rotation of the internal combustion engine to provide control voltages to the ignition transformer 26. During the time the light beam from the diode 100 to the transistor 102 is interrupted, the transformer 26 is storing energy from the battery 24.

The battery voltage is applied to the light emitting diode 100 through a current limiting resistor 104. Also tied to the battery 24 is the collector electrode of the photo transistor 102 having an emitter electrode coupled to an input stage transistor 106 through an input network comprising resistors 108 and 110. As in the embodiment of FIG. 2, input transistor 106 is one of three stages of a pulse width amplifier for establishing the duty cycle of the firing circuit 22.

Coupled between the collector and base electrodes of the transistor 106 is a filtering capacitor 112 that functions to prevent transients in the circuit from false triggering the timing cycle of the pulse width amplifier. Also connected to the collector electrode of the transistor 106 is a drive resistor 114 for establishing current levels through the transistor from the battery 24.

A voltage developed at the collector electrode of the transistor 106 is direct coupled to the base electrode of a second stage transistor 116 that has a grounded emitter electrode. Connected to the collector electrode of the transistor 116 is a drive resistor 118 also connected to the battery 24 to establish operating current levels in the transistor.

Direct coupled to the collector electrode of the transistor 116 is the base electrode of a transistor 120 that functions as the output stage of the pulse width amplifier. A drive resistor 122 connected to the battery 24 and the collector electrode of the transistor 120 establishes the operating current level of the transistor. A voltage generated at the collector electrode of the transistors 120 is fed back to the base electrode of the transistor 116 through a feedback resistor 124. This serves to regenerate the timing function thereby improving the switching transition time. The emitter electrode of the transistor 120 is grounded.

An output voltage as generated at the collector electrode of the transistor 120 is coupled through a diode 126 to the base electrode of a transistor 128 as part of a Darlington amplifier output driver 130. Also coupled to the base electrode of the transistor 128 is a clamping circuit including a diode 132 in parallel with a resistor 134.

The Darlington amplifier, as in FIG. 5, comprises the transistor 128 and an emitter coupled transistor 136 having a common collector electrode connection with the transistor 128 to a line 138. Connected to the line 138 is the primary winding 76 (see FIG. 2) of the ignition transformer 26 to develop the trigger voltage on the line 14 for applying to a spark source, such as the spark source 20.

A base drive voltage for the transistor 128 is developed across a resistor 140 and a base drive voltage for the transistor 136 is developed across a resistor 142. The emitter electrode of the transistor 136 and the resistor 142 are grounded. As illustrated in FIG. 1, the negative terminal of the battery 24 is likewise grounded.

Connected across the Darlington amplifier 130 to resonate with the primary winding 76 is a capacitor 144 also grounded. In parallel with the amplifier 130 and the capacitor 144 is a varistor 146. The varistor 146 functions as a clamping circuit.

The varistor 146 is a voltage dependent, symmetrical resistor which functions in a manner similar to back-to-back Zener diodes in circuit protective applications. When exposed to a high energy voltage, the impedance of the varistor 146 changes from a very high standby value to a very low conducting value, thus clamping the collector to emitter voltage differential to a safe value and thereby prevent damage to the amplifier 130. The excess energy of the high voltage is absorbed by the varistor 146, thus protecting the sensitive transistors of the amplifier 130.

In operation of the circuit of FIG. 5, and with reference to FIG. 6, when the rotating disc of the distributor 10 blocks the light beam from the light emitting diode 100 to the photo transistor 102, transistors 106 and 120 are non-conducting and the transistors 116 and the Darlington amplifier 130 are in a conducting state. The ignition transformer 26 is now connected to the battery 24. As the disc rotates to allow light from the diode 100 to the transistor 102 the latter transitions into a conducting state through the current limiting resistor 108 to develop a bias voltage across the resistor 110 to turn on the transistor 106. The waveform at the emitter electrode of the transistor 102 is shown in FIG. 6*a* with the conduction cycle illustrated by the positive pulse 152.

Figure 6A:
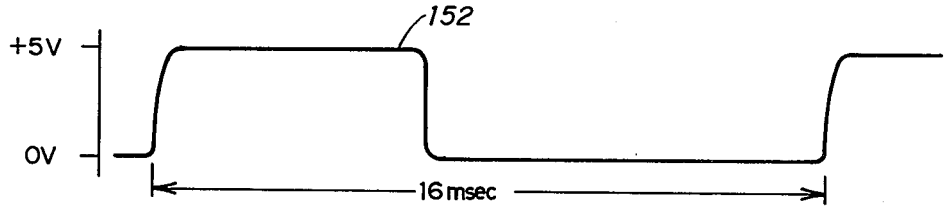
FIG. 6 is a series of waveforms illustrating voltage levels generated by operation of the circuit of FIG. 5.
Figure 6B:
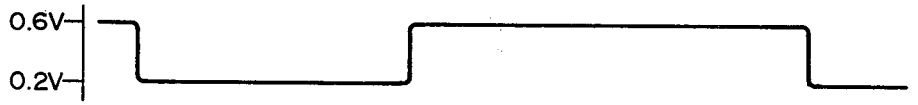
Figure 6C:
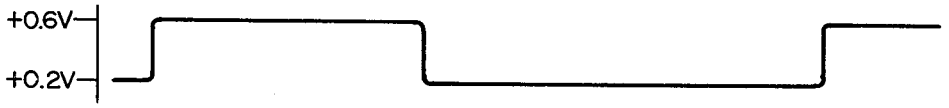
Figure 6D:
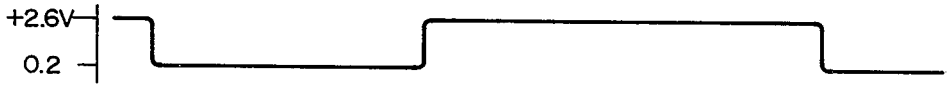

Conduction of the transistor 106 drives the base electrode of the transistor 116 to near ground potential through the grounded emitter electrode of the transistor 106 thereby turning off the transistor 116. The waveform of the voltage at the collector electrode of the transistor 106 is shown in FIG. 6*b*. As the transistor 116 turns off, the collector electrode goes high as shown in FIG. 6*c*, thereby turning on the transistor 120 to drive the collector electrode voltage thereof to near ground potential as shown by the curve of FIG. 6*d*. As mentioned previously, the output of the transistor 120 at the collector electrode is fed back through the feedback resistor 124 to the base electrode of the transistor 116 causing a regenerative action to enhance switching speed.

The output voltage at the collector of the transistor 120 is also coupled through the diode 126 to the base electrode of the transistors 128 as part of the Darlington amplifier 130. The grounded collector state of the transistor 120 causes the transistor 128 and the transistor 136 to turn off thereby disconnecting the transformer 26 from the battery 24. The turnoff characteristics of the Darlington amplifier 130 are enhanced by the reverse recovery characteristics of the diode 126 by driving the base of the transistor 128 farther negative.

Figure 6E:
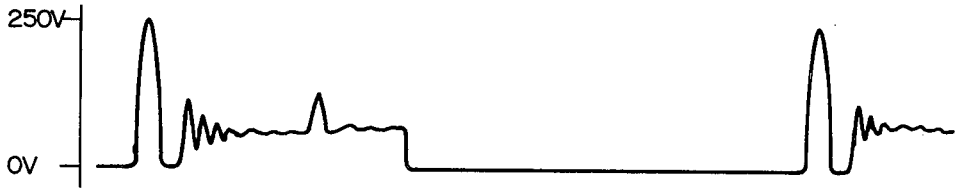

The collapsing field of the primary winding 76 of the transformer 26 includes a high voltage on the line 14 to thereby apply a high voltage potential across the spark source 20. This voltage is illustrated by the waveform of FIG. 6*e*.

During the collapsing field in the ignition transformer 26 the collector electrode of the transistors 128 and 136 goes positive by the resonant action of the winding 76 and the capacitor 144. The voltage across the transistors 128 and 136 is clamped to a safe operating level by the varistor 146. During this clamping time, the diode 126 is reverse biased. The collector voltage of the transistors 128 and 136 then swings negative and the voltage at the winding 76 is clamped by forward biasing the collector base junction of the transistors of the Darlington amplifier 130 and forward biasing the diode 132. This operation continues as a series of damped oscillations as shown in FIG. 6*e* until the disc again interrupts the light beam between the light emitting diode 100 and the photo transistor 102.

Interrupting the light beam to the photo transistor 102 causes the transistor to turn off which removes the base drive to the transistor 106 and this transistor turns off. The transistor 116 then turns on to thereby turn off the transistor 120. The Darlington amplifier 130 again goes into a conduction state with current flowing through the ignition transformer 26 storing energy in the primary winding 76 from the battery 24 for the next interruption of the light path to the photo transistor 102.

In a model of the firing circuit 22 of FIG. 5, the various component values are given in Table II below.

TABLE II

| TYPICAL COMPONENT VALUE | |
|---|---|
| Resistor 108 | 1K ohms |
| Resistor 110 | 15K ohms |
| Resistor 114 | 3.3K ohms |
| Resistor 118 | 1K ohms |
| Resistor 124 | 10K ohms |
| Resistor 122 | 100 ohms |
| Resistor 130 | 1K ohms |
| Resistor 104 | 620 ohms |
| Capacitor 112 | .01 Mfd 50 volt |
| Capacitor 144 | .22 Mfd 400 volt |
| Diode 126 | 1N4001 |

TABLE II-continued

| TYPICAL COMPONENT VALUE | |
|---|---|
| Diode 130 | 1N4001 |
| Varistor 146 | Type VP (MOV) |
| Photodiode 100 | TIL31 |
| Transistor 106 | MPS5172 |
| Transistor 116 | MPS5172 |
| Transistor 120 | 2N4400 |
| Darlington Amplifier 130 | SVT6204 (400 volt, 10 amp, NPN transistor) |
| Photo Transistor 102 | TIL81 |

While several embodiments of the invention, together with modifcations thereof, have been described in detail herein and shown in the accompanying drawings, it will be evident that various further modifications are possible without departing from the scope of the invention.

What is claimed is:

1. A firing circuit in an ignition control system responsive to an input signal from a mechanical-to-electrical transducer and providing a control voltage to an ignition transformer generating a trigger voltage to a spark source, comprising in combination:

a multiple stage pulse width amplifier having an input transistor, an output transistor and a second stage transistor;

a coupling capacitor connected between the collector electrode of the input transistor and the base electrode of the second transistor;

a voltage divider network of a first resistor in series with a second resistor to establish a voltage level at the resistor interconnection;

a diode having an anode connection to the coupling capacitor and a cathode terminal to the interconnection of the resistors of said voltage divider network to control the conduction cycle of said second transistor through the coupling capacitor;

a first feedback network connected from the collector electrode of the output transistor to the collector electrode of the input transistor;

a second feedback network from the collector electrode of the second stage transistor to the base electrode of the input transistor; and an output driver including a semiconductor amplifier connected to the output transistor and providing a control voltage to the ignition transformer.

2. A firing circuit in an ignition control system as set forth in claim 1 including a capacitor filter connected between the collector and base electrodes of the input transistor.

3. A firing circuit in an ignition control system as set forth in claim 1 including a clamping circuit of a voltage dependent, symmetrical resistor connected across said semiconductor amplifier.

4. A firing circuit in an ignition control system as set forth in claim 1 including a clamping circuit connected across the semiconductor amplifier thus clamping the voltage differential across the amplifier to a safe value.

5. A firing circuit in an ignition control system responsive to an electrical signal from a mechanical-to-electrical transducer and providing a control voltage to an ignition transformer generating a trigger voltage to a spark source, comprising in combination:

a multiple stage pulse width amplifier having an input transistor, a second stage transistor and an output transistor;

a voltage divider network of a first resistor in series with a second resistor for establishing a voltage level at the resistor interconnection;

a coupling capacitor interconnecting the output of the input transistor to the input of the second stage transistor;

a diode having an anode connection to said coupling capacitor and a cathode terminal interconnected to the junction of the resistors of said divider network;

a first feedback network from the collector electrode of the second stage transistor to the base electrode of the input transistor;

a second feedback network connected from a collector electrode of the output transistor to the collector electrode of the input transistor;

a capacitor filter connected between the collector and base electrodes of the input transistor; and an output driver including a semiconductor amplifier connected to the output transistor and providing a control voltage to the ignition transformer.

6. A firing circuit in an ignition control system as set forth in claim 5 including a voltage dependent, symmetrical resistor connected across said semiconductor amplifier.

7. A firing circuit in an ignition control system responsive to an electrical signal from a mechanical-to-electrical transducer and providing a control voltage to an ignition transformer generating a trigger voltage to a spark source, comprising in combination:

a multiple stage pulse width amplifier having an input transistor and an output transistor;

a capacitor filter connected between the collector and base electrodes of the input transistor;

an output driver including a semiconductor amplifier connected to the output transistor and providing a control voltage to the ignition transformer; and a clamping circuit including a voltage dependent, symmetrical resistor that changes impedance when exposed to a high energy voltage connected across said semiconductor amplifier to provide overvoltage protection for said semiconductor amplifier.

8. A firing circuit in an ignition control system as set forth in claim 7 wherein said amplifier includes a second stage transistor coupled to the input transistor and further including a feedback network from the collector electrode of the second stage transistor to the base electrode of the input transistor.

9. A firing circuit in an ignition control system as set forth in claim 8 wherein said amplifier includes a voltage divider network and a diode connected between the collector electrode of the input transistor and said divider network.

10. A firing circuit in an ignition control system responsive to an electrical signal from a mechanical-to-electrical transducer and providing a control voltage to an ignition transformer generating a trigger voltage to a spark source, comprising in combination:

a multiple stage pulse width amplifier having an input transistor, a second stage transistor, and an output transistor;

a feedback network connected from the collector electrode of the output transistor to the collector electrode of the input transistor;

a capacitor filter connected between the collector and the base electrodes of the input transistor;

an output driver including a semiconductor amplifier connected to the output transistor and providing a control voltage to the ignition transformer; and a clamping circuit including a voltage dependent, symmetrical resistor that changes impedance when exposed to a high energy voltage connected across the semiconductor amplifier to provide overvoltage protection for said amplifier.

11. A firing circuit in an ignition control system as set forth in claim 10 including a second feedback network from the collector electrode of the second stage transistor to the base electrode of the input transistor.

12. A firing circuit in an ignition control system as set forth in claim 11 wherein said amplifier includes a voltage divider network and a diode connected between the collector electrode of the input transistor and said divider network.

13. A firing circuit in an ignition control system responsive to an electrical signal of a mechanical-to-electrical transducer and providing a control voltage to an ignition transformer generating a trigger voltage to a spark source, comprising in combination:

a pick-up as a part of the mechanical-to-electrical transducer and including a light emitting diode generating energy to a photo transistor;

a multiple stage pulse width amplifier having an input transistor and an output transistor;

a voltage divider network of a first resistor interconnected to a second resistor with the interconnection to the base electrode of the input transistor and the first resistor connected to the photo transistor of said pick-up;

a feedback network connected from the collector electrode of the output transistor to the collector electrode of the input transistor;

an output driver including a semiconductor amplifier connected to the output transistor and providing a control voltage to the ignition transformer; and a diode coupling between the output transistor and the input to said semiconductor amplifier.

14. A firing circuit in an ignition control system as set forth in claim 13 including a clamping circuit comprising a voltage dependent, symmetrical resistor that changes impedance when exposed to a high energy voltage connected across the semiconductor amplifier.

15. A firing circuit in an ignition control system as set forth in claim 14 wherein said output driver further includes a capacitor connected across the output of said semiconductor amplifier.

16. A firing circuit in an ignition control system as set forth in claim 15 including a diode clamp connected to the input of said semiconductor amplifier.

17. A firing circuit in an ignition control system as set forth in claim 16 including a capacitor filter connected between the collector and base electrodes of the input transistor.

* * * * *